United States Patent [19]

Nicowski

[11] Patent Number: 4,813,213

[45] **Date of Patent: * Mar. 21, 1989**

[54] HORSE "Z" GUIDE

[76] Inventor: Edward Nicowski, 194 Lake Street, St. Catharines, Ontario, Canada, L2R 5Z1

[ * ] Notice: The portion of the term of this patent subsequent to Apr. 21, 2005 has been disclaimed.

[21] Appl. No.: 702,365

[22] Filed: Feb. 15, 1985

[51] Int. Cl.[4] ..... B68B 1/04

[52] U.S. Cl. ..... 54/6 R

[58] Field of Search ..... 54/6 R, 6 A, 15, 71

[56] References Cited

U.S. PATENT DOCUMENTS

| | | | |
|---|---|---|---|
| 273,077 | 2/1883 | Heinisch | 54/6 A |
| 1,116,691 | 11/1914 | Gradberg | 54/6 R |
| 2,025,469 | 12/1935 | Miller | 54/6 R |
| 2,066,087 | 12/1936 | Barrera | 54/6 R |
| 2,097,611 | 11/1937 | Adams | 54/71 |
| 2,469,046 | 5/1949 | Laws | 54/6 R |
| 2,471,121 | 5/1949 | Reed, Jr. | 54/6 R |
| 3,318,069 | 5/1967 | Cunard | 54/6 R |
| 4,214,420 | 7/1980 | Ferree | 54/71 X |
| 4,583,493 | 4/1986 | Terry | 54/71 X |
| 4,589,248 | 5/1986 | Ruddock et al. | 54/6 A X |

*Primary Examiner*—Robert P. Swiatek

*Attorney, Agent, or Firm*—Rogers & Scott

[57] ABSTRACT

The invention comprises a check for control of the downward movement of the head of an animal having a forwardly elongated head, such as a horse, which includes a pair of rigid side members adapted for location one on each side of the head of the animal. The side members are joined at their lower ends by a cross member adapted for bearing against the lower forward part of the head, and at an intermediate portion by a support member adapted for resting on an upper part of the head. Straps extend from upper ends of the side members over the head to a fixed point on a harness on the body of the animal, so that the pull on the straps is applied to the lower cross member with the head held firmly between the lower cross member and the intermediate support member.

11 Claims, 2 Drawing Sheets

HORSE "Z" GUIDE

FIELD OF THE INVENTION

This invention relates to a check for use in the control of the downward movement of the heads of animals, and in particular to the control of the heads of horses in the sport of harness racing.

BACKGROUND OF THE INVENTION

In harness racing, and other uses of draft animals, it is common practice to use a bridle having a bit for location in the mouth of the horse. Control of the head of the horse is achieved by pulling reins attached to the bridle, which pull the bit further into the mouth and also pulls the head of the horse downwards.

In situations where a horse is difficult to control the rider may pull on the reins with such force that the bit may damage the mouth and teeth. Jerking and bad driving may have a similar effect. The presence of the bit in the mouth may also result in breathing problems, choking, and even swallowing of the tongue. In addition, as mentioned above, pulling on the reins tends to pull the head downwards. Occasions have arisen where the heads of horses involved in harness races have been pulled downwards to such an extent that the horses have tripped and fallen, resulting in severe, and occasionally fatal, injury to the horses and riders.

Checks have therefore been used to help prevent the head of a difficult to control horse from being pulled downwards, by the driver pulling on the reins or by the horse itself. Such checks are commonly in the form of a leather loop which is passed over the forward end of the head and attached to a fixed point on a harness by an adjustable strap which passes over the head and between the ears. However, as a horse pulls downwardly against such a check, the loop tends to deform to constrict around the mouth and may interfere with the bit of the bridle. Also, the lips and skin of the horse tend to become caught between the loop and the bit and may be damaged.

SUMMARY OF THE INVENTION

It is an object of the present invention to provide a check which allows a driver to set the height of the head of a horse or other draft animal.

It is a further object of the present invention to provide a check arranged such that pulling on the reins does not tend to pull the head downwards.

In accordance with the present invention there is provided a check for control of the downward movement of the head of an animal having a forwardly elongated head comprising:

a pair of rigid spaced side members having respective upper and lower ends and adapted for location one on each side of the head of the animal to extend between upper and lower surfaces of the head;

a lower cross member extending between the lower ends of the side members and adapted for abutting securely against a forward part of the lower surface of the head of the animal for application thereto of an upward force restraining said downward movement;

an intermediate support member extending between the side members intermediate of the ends of the side members and adapted for abutting the upper surface of the head of the animal to support the check on the animal head with the head between the lower cross member and the intermediate support member; and flexible elongate members extending from the upper ends of the side members and passing over the head of the animal for attachment to a fixed point on a harness mounted on the body of the animal rearwardly of the head and to thereby oppose any downward movement of the animal head.

The invention will be better understood from a consideration of the following detailed description of a preferred embodiment of the present invention when taken together with the accompanying drawings, in which:

DETAILED DESCRIPTION OF PREFERRED EMBODIMENT

Figure 1:
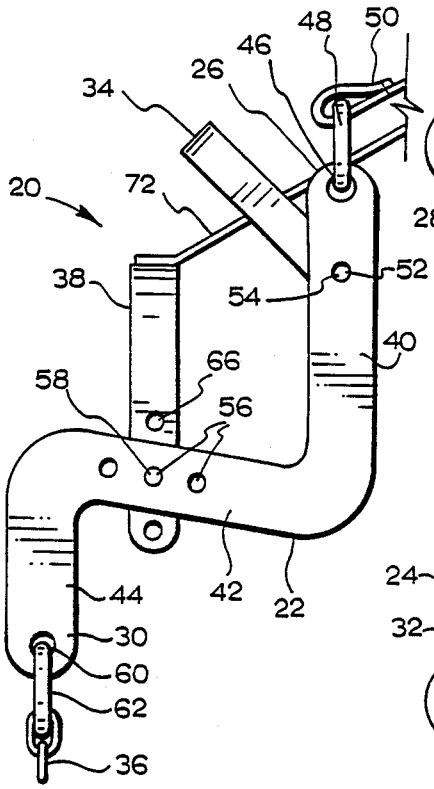
FIG. 1 is a side view of a preferred embodiment of the check of the present invention.
Figure 2:
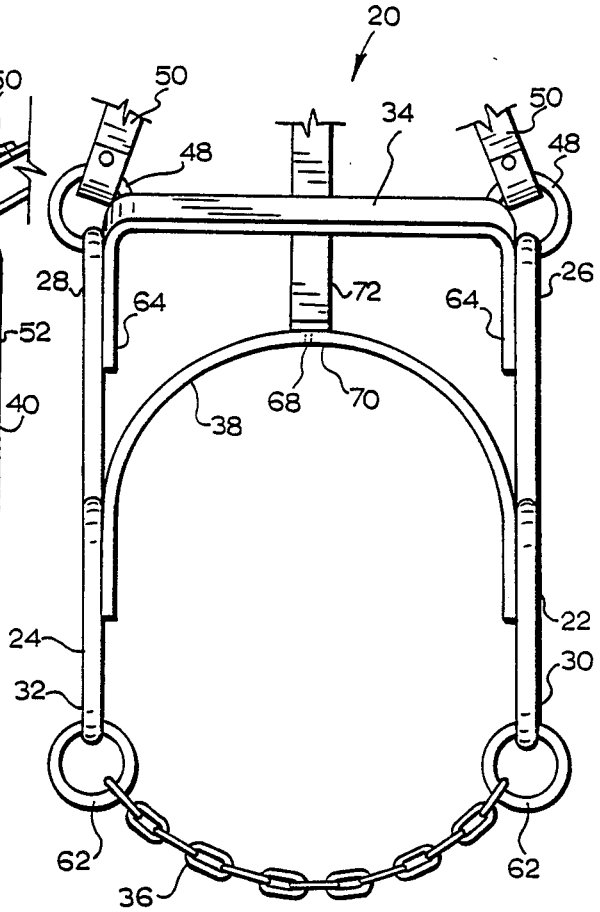
FIG. 2 is a front view of the check of FIG. 2.

Reference is made to the drawings, which show a check, designated generally by the reference numeral 20. The check 20 is shown fitted on a horse in FIG. 3 and the components of the check will be described firstly with particular reference to FIGS. 1 & 2. The check is provided in addition to the usual bridle and bit which are not shown. The check includes a pair of elongate side member 22, 24. The side members 22, 24 are joined at their upper ends 26, 28 by an upper cross member 34, at their lower ends 30, 32 by a lower cross member in the form of a chain 36, and also at an intermediate portion by means of an intermediate support member 38.

Each side member 22, 24 includes an upper portion 40, an intermediate portion 42, and a lower portion 44 which collectively generally define a Z-shape rotated through 90°. Eachof the longer upper portions 40 is provided with a hole 46 at its upper end 28 to receive a ring 48 for connection to respective straps 50. Further holes 52 are provided adjacent the upper ends 26, 28 for receiving suitable attachments 54, such as bolts, used to secure the upper cross member 34 to the side members 22, 24. The intermediate portion 42 extends at an acute angle from the lower end of the upper portion and is of slightly shorter length than the upper portion 40. A number of holes 56 are provided in the intermediate portion 42 for receiving attachments 58, such as bolts, used to secure the support member 38 to the side members 22, 24 in a variety of positions as permitted by the different locations of the holes 56. The shorter lower portion 44 extends downwardly from the leading end of the intermediate portion 42 at an acute angle just less than 90°. Holes 60 are provided at the lower ends 30, 32 of the lower portions 44 to accomodate the end links 62 of the chain 36.

The upper cross member 34 is joined to the side members by means of attachments 54 as described above and is formed of a U-shaped piece provided with end holes 64 for receiving the attachments 54.

The intermediate support member 38 is generally arcuate in shape, corresponding to the shape of the head of the animal on which the check is to be mounted, and is provided with end holes 66 for receiving the attachments 58 which secure the member 38 to the intermediate portions 42. A number of holes 66 are provided at each end of the member 38, constituting multiple points of connection, to permit adjustment of the member 38 to accomodate different shapes and sizes of head. A further hole 68 is provided in the middle part of the member 38 for receiving a suitable attachment 70 to retain a strap 72 used to hold the check 20 on the head of the horse, this strap being connected to the horse's headress (not shown) for this purpose.

Figure 3:
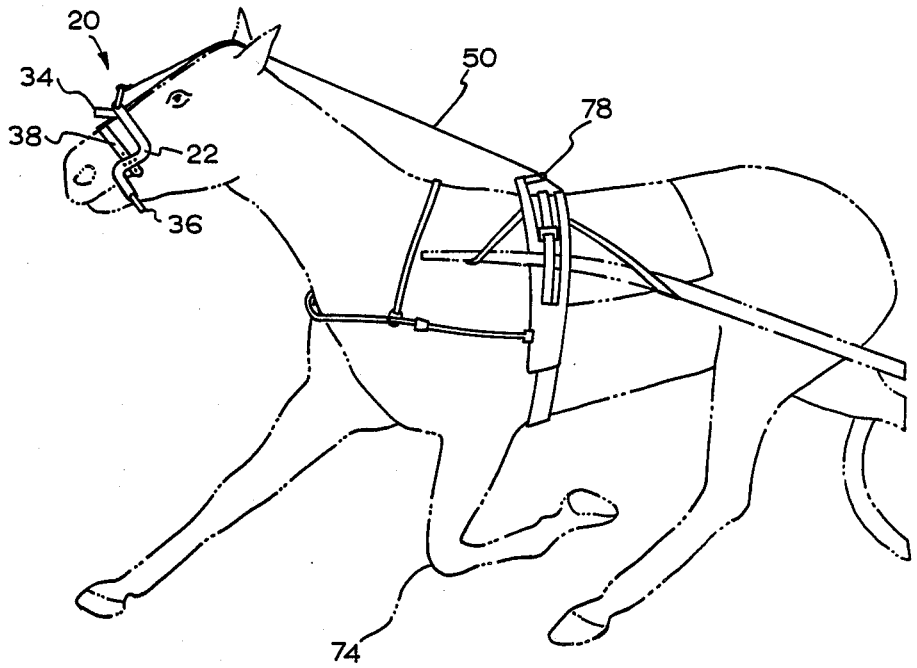
FIG. 3 is a side view of the check of FIG. 1 fitted to a horse (shown in chain dotted outline).

Reference is now made to FIG. 3 of the drawings which shows the check 20 located on a the head of a horse 74. As can be seen from the drawing, the support member 38 rests on the nose while the chain 36 extends beneath the forward part of the head. The upper cross member 34 extends above and across of the head.

Control of the head is achieved by setting the lengths of the adjustable straps 50 which extend from the rings 48 and pass between the ears of the horse to a fixed point on a body harness 78. Tightening of the straps 50 causes the check 20 to pivot on the nose about the support member 38, thus causing the chain 36 to bear against the lower part of the head, the head thus being held firmly between the lower cross member and the support member for the application of this restraint. Downward movement of the is thus restrained by the straps.

From this it will be appreciated that the check of the present invention allows a rider or driver to set the position of the head of a horse or other draft animal without interfering with the operation of the bit.

It will be appreciated that the preceding description is made by way of example only and that various modifications and changes may be made in the construction and arrangement of elements comprising the preferred form of the present invention without departing from the scope of the present invention.

We claim:

1. A check for control of the downward movement of the head of an animal having a forwardly elongated head comprising:

a pair of rigid spaced side members having respective upper and lower ends and adapted for location one on each side of the head of the animal to extend between upper and lower surfaces of the head;

a lower cross member extending between the lower ends of the side members and adapted for abutting securely against a forward part of the lower surface of the head of the animal for application thereto of an upward force restraining said downward movement;

an intermediate support member extending between the side members intermediate of the ends of the side members and adapted for abutting the upper surface of the head of the animal to support the check on the animal head with the head between the lower cross member and the intermediate support member; and flexible elongate members extending from the upper ends of the side members and passing over the head of the animal for attachment to a fixed point on a harness mounted on the body of the animal rearwardly of the head and to thereby oppose any downward movement of the animal head.

2. A check as claimed in claim 1, in which an upper cross member is provided for extending between the upper ends of the side members, and adapted to extend over and clear of an upper part of the head of the animal.

3. A check as claimed in claim 1, in which the lower cross member is flexible.

4. A check as claimed in claim 3, in which the lower cross member is in the form of a chain.

5. A check as claimed in claim 1, in which the intermediate support member is arcuate in shape so as to conform to the shape of the said upper surface of the head of the animal.

6. A check as claimed in claim 1, in which the side members, the cross member and the support member are substantially elongate.

7. A check as claimed in claim 1, in which the said side members are of substantially Z-shape, the said lower cross member extends between two respective ends of the side members, and the said intermediate support member extends between the two respective intermediate portions of the Z-shape side members.

8. A check as claimed in claim 1, in which the said side members are of substantially Z-shape, the said lower cross member extends between two respective ends of the side members, the said intermediate support member extends between the two respective intermediate portions of the Z-shape side members, and the upper cross member extends between the other two respective ends of the side members.

9. A check as claimed in claim 1, wherein the side members and the intermediate support member are provided with multiple points of connection to one another for adjustment of the intermediate support member to conform to the head of the animal on which the check is placed.

10. A check as claimed in claim 1, wherein a strap member for holding the check on the animal head extends from the intermediate support member for connection to a headress of the animal.

11. A check as claimed in claim 1, wherein the flexible elongate membes are straps of adjustable length.

* * * * *